US008729376B2

(12) United States Patent
Kakishita

(10) Patent No.: US 8,729,376 B2
(45) Date of Patent: May 20, 2014

(54) MUSICAL SOUND SYNTHESIZING APPARATUS

(75) Inventor: Masahiro Kakishita, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 109 days.

(21) Appl. No.: 13/429,016

(22) Filed: Mar. 23, 2012

(65) Prior Publication Data

US 2012/0240750 A1 Sep. 27, 2012

(30) Foreign Application Priority Data

Mar. 24, 2011 (JP) ..... 2011-066742

(51) Int. Cl.
*G10H 1/06* (2006.01)

(52) U.S. Cl.
USPC ..... 84/622

(58) Field of Classification Search
USPC ..... 84/622, 659
See application file for complete search history.

(56) References Cited

U.S. PATENT DOCUMENTS 5,256,830 A * 10/1993 Takeuchi et al. ..... 84/625
5,304,734 A * 4/1994 Kunimoto ..... 84/661
5,382,751 A * 1/1995 Kitayama et al. ..... 84/661
5,587,548 A * 12/1996 Smith, III ..... 84/659
5,641,931 A * 6/1997 Ogai et al. ..... 84/661
5,648,629 A 7/1997 Kozuki
8,115,092 B2 * 2/2012 Tominaga ..... 84/719
8,178,772 B2 * 5/2012 Iwase ..... 84/661
2008/0245213 A1 * 10/2008 Izumisawa ..... 84/604
2009/0031886 A1 * 2/2009 Iwase ..... 84/661
2010/0307322 A1 * 12/2010 Tominaga ..... 84/622
2012/0111178 A1 * 5/2012 Tominaga ..... 84/622
2012/0240750 A1 * 9/2012 Kakishita ..... 84/604

FOREIGN PATENT DOCUMENTS

JP 04-343394 A 11/1992
JP 07-020859 A 1/1995
JP 2-650509 B2 9/1997
JP 2-828872 B2 11/1998

* cited by examiner

*Primary Examiner* — Jeffrey Donels
(74) *Attorney, Agent, or Firm* — Morrison & Foerster LLP

(57) ABSTRACT

In a musical sound synthesizing apparatus, a loop part including at least a delay element is configured to receive an excitation signal in response to a sound generation instruction so as to synthesize a musical sound signal by looping the excitation signal therein. A waveform memory stores first waveform data representing sound which is generated by a natural musical instrument and which contains resonance, the first waveform data containing a plurality of frequency components having various levels. A waveform processing unit removes, from the first waveform data, one or more frequency component having a level that does not reach a predetermined level, to generate second waveform data. The second waveform data generated by the waveform processing unit is input as the excitation signal to the loop part.

5 Claims, 7 Drawing Sheets

MUSICAL SOUND SYNTHESIZING APPARATUS

BACKGROUND OF THE INVENTION

1. Technical Field of the Invention

The present invention relates to a musical sound synthesizing apparatus for synthesizing a musical sound signal using waveform data acquired in advance.

2. Description of the Related Art

Attempts to electronically reproduce musical sounds generated from a natural musical instrument by simulating the action of the natural musical instrument have been made.

Among natural musical instruments, in a piano, for example, sound is produced when a hammer strikes a string corresponding to a depressed key of a keyboard from among a plurality of arranged strings, and releasing the key just triggers a damper to come into contact with the string to suppress vibration of the string, thereby stopping the sound. When a certain string is vibrated, not only does the string generate a sound but neighboring strings resonate or the vibration of the string is propagated to other strings through a sound board to vibrate the other strings. This resonance or propagation of vibration is an important element of the characteristic sound of a piano.

Attempts to electronically reproduce the characteristic sound of a piano are disclosed in Patent Publications.

Patent Publication No. 2828872 describes that a resonant sound generation channel is set for a string corresponding to each pitch, and a musical sound signal of a pitch corresponding to a depressed key, which is generated by a sound source, is input to the corresponding resonant sound generation channel so as to generate a resonant sound corresponding to the pitch.

Patent Publication No. 2650509 discloses that a musical sound signal that simulates vibration of a string of a piano is input to a filter that simulates a propagation state of vibration from a bridge to a sound board in the piano, and a musical sound signal output from the filter or a musical sound signal before being filtered and the musical sound signal are output as a musical sound.

However, for simulation of the behavior of a natural musical instrument with strings, a method of generating a signal indicating a sound according to vibration of a string and creating a signal representing a sound caused by resonance or propagation of the vibration to other strings on the basis of the signal is considered to be useful to obtain an artificial sound closer to the natural sound of the musical instrument. This is because a string initially produces sound on the basis of manipulation by a performer of a natural musical instrument with strings, in general.

As to generation of a signal indicating a sound caused by vibration of a string, Patent Publication No. 2828872 describes a method of imparting a desired tone to a musical sound signal of a pitch corresponding to a depressed key using a waveform memory sound source and, simultaneously, generating a musical sound signal given an envelope according to a playing operation. Patent Publication No. 2650509 discloses a method that generates a signal indicating a sound caused by vibration of a string by applying data indicating an initial velocity of a hammer to a string model that is a physical model which simulates a vibrating state of the string according to strike of the hammer using a physical model sound source.

However, the method disclosed in Patent Publication No. 2650509 is not suitable to reproduction of musical tones of a musical instrument of a specific model although the method allows features of acquired musical tones to be controlled to a certain degree through parameter adjustment because a model for reproducing interaction between a hammer and a string is complex. When musical tones of a musical instrument of a specific model need to be reproduced with little effort, it is effective to use a waveform memory sound source that uses a waveform obtained by sampling the waveform of a musical sound actually generated by the musical instrument.

However, even when the waveform memory sound source is used, the method disclosed in Patent Publication No. 2828872, for example, needs to obtain a musical sound signal that does not include resonance of a sound board or a string as a musical sound signal of each pitch, which is stored in the sound source. This is because it is impossible to reproduce a sound solely associated to vibration of the string if the musical sound signal includes another sound caused by resonance of the sound board or string. Accordingly, a sampling operation needs to be carried out with a sound deadener arranged such that all strings other than a string producing sound and the sound board are not vibrated and requires extraordinary effort. Therefore, the conventional method cannot easily reproduce musical tones of musical instruments of various models.

SUMMARY OF THE INVENTION

The invention has been made in view of this circumstance and it is an object of the invention to generate an excitation signal supplied to a string model of a stringed instrument from a waveform obtained by sampling sound of the stringed instrument.

To accomplish the object of the present invention, there is provided a musical sound synthesizing apparatus comprising: a loop part including at least a delay element, the loop part being configured to receive an excitation signal in response to a sound generation instruction so as to synthesize a musical sound signal by looping the excitation signal therein; a waveform memory that stores first waveform data representing sound which is generated by a natural musical instrument and which contains resonance, the first waveform data containing a plurality of frequency components having various levels; and a waveform processing unit that removes, from the first waveform data, one or more frequency component having a level that does not reach a predetermined level, to generate second waveform data, wherein the second waveform data generated by the waveform processing unit is input as the excitation signal to the loop part.

In the musical sound synthesizing apparatus, the waveform processing unit may be equipped with a separator that separates the first waveform data into waveform data of a plurality of frequency bands; a plurality of level controllers that respectively correspond to the plurality of the frequency bands, each level controller detecting a level of the waveform data of the corresponding frequency band and damping the waveform data when the detected level does not reach the predetermined level, thereby removing a frequency component contained in the first waveform data; and a waveform synthesizer that mixes the waveform data output from the plurality of the level controllers to generate the second waveform data.

Otherwise, the waveform processing unit may be equipped with a frequency analyzer that analyzes the first waveform data so as to obtain a first frequency characteristic indicating frequency components contained in the first waveform data; a damping unit that decreases a level of one or more frequency component which does not reach a predetermined level in the first frequency characteristic so as to obtain a second frequency characteristic; and a waveform synthesizer that generates the second waveform data having the second frequency characteristic.

According to the musical sound synthesizing apparatus of the present invention, an excitation signal supplied to a string model of a stringed instrument can be generated from a waveform obtained by sampling sound of the stringed instrument.

DETAILED DESCRIPTION OF THE INVENTION

Embodiments of the present invention will be described in detail with reference to the attached drawings.

Figure 1:
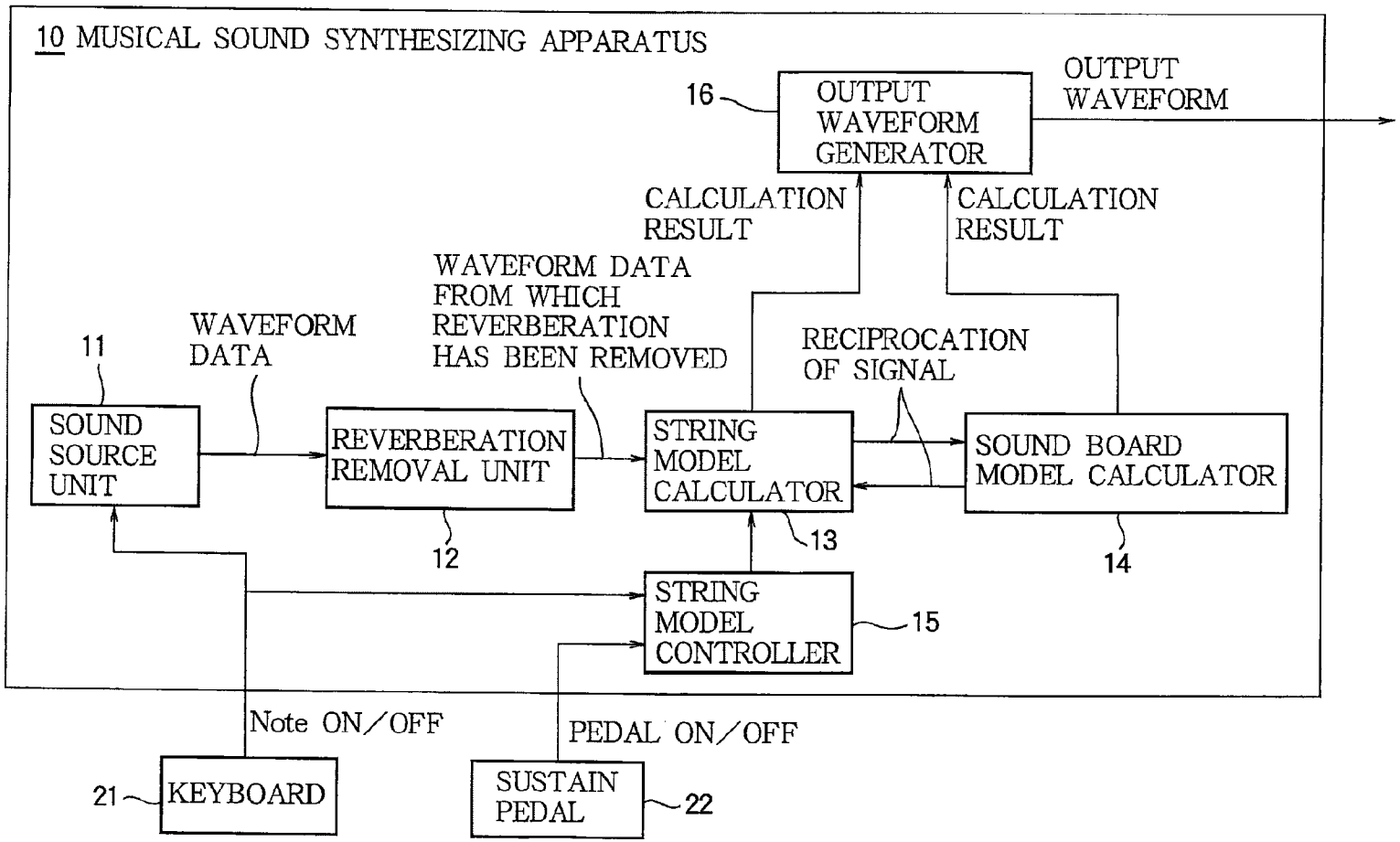
FIG. 1 is a block diagram of a musical sound synthesizing apparatus according to an embodiment of the present invention.

FIG. 1 is a block diagram of a musical sound synthesizing apparatus according to an embodiment of the present invention.

Referring to FIG. 1, the musical sound synthesizing apparatus includes a sound source unit 11, a reverberation removal unit 12, a string model calculator 13, a sound board model calculator 14, a string model controller 15, and an output waveform generator 16. Manipulation information (note-on event) according to a key strike is input to the sound source unit 11 from a keyboard 21, and manipulation information (note-off event) according to key release in addition to the manipulation information (note-on event) and manipulation information regarding pedal on/off from a sustain pedal 22 are input to the string model controller 15.

Among the above-mentioned components, the sound source unit 11 detects a note-on event inputted as a sound generation instruction from the keyboard 21 and generates digital waveform data of a musical sound generated by a struck key having a pitch corresponding to the note-on event in an acoustic piano (simply referred to as a piano hereinafter).

The sound source unit 11 generates the digital waveform data that has been obtained by striking keys of the piano one by one and that is stored in a waveform memory through pulse code modulation (PCM). The digital waveform data are respectively matched to pitches of respective keys (and velocities of struck keys) and stored in the waveform memory. When a note-on event is generated, the sound source unit 11 reads waveform data corresponding to a pitch (and velocity) according to the note-on event from the waveform memory, sets an envelope in response to the velocity and outputs the resulting waveform data, thereby generating first waveform data according to a depressed key.

It is possible to reduce the number of samplings by sampling waveform data corresponding to one pitch for every range of 3 to 5 keys and shifting pitches of the sampled waveform data to pitches corresponding to depressed keys in the event of playing the piano.

The waveform data stored in the waveform memory is waveform data obtained by striking keys of the piano in a natural state, that is, waveform data of sounds including resonance of strings, vibration of the sound board, reverberation caused by propagation of vibration between strings via bridges and the sound board, etc. The current embodiment is characterized in that the string model calculator 13 can be appropriately driven using this waveform data.

The reverberation removal unit 12 is a waveform processing unit for removing components other than a waveform generated by strike of a hammer on a string according to a key strike from waveform data output from the sound source unit 11. This function will be described in detail later.

The string model calculator 13 and the sound board model calculator 14 perform calculations according to models that respectively simulate actions of strings and the sound board of the piano. Further, the string model calculator 13 and the sound board model calculator 14 output waveform data indicating sounds generated from each string and the sound board of the piano as calculation results while transmitting/receiving audio signals to/from each other. These functions will now be described in detail particularly focusing on the string model calculator 13.

The string model controller 15 simulates an operation of the piano on the basis of manipulation information regarding key strike/key release and manipulation information regarding on/off of the sustain pedal and controls parameters which indicate operations of dampers, and which are used for calculations performed by the string model calculator 13. In addition, the string model controller 15 performs a control operation when the parameters need to be changed according to a calculation operation.

The output waveform generator 16 mixes waveform data of a sound generated from each string, which is a calculation result of the string model calculator 13, and waveform data of a sound generated from the sound board, which is a calculation result of the sound board model calculator 14, to thereby synthesize waveform data of sound generated according to a playing operation. It is possible to generate waveform data of a plurality of channels. For example, waveform data suitable to reproduce musical sounds in a sound system equipped with three speakers is output, as described in Patent publication No. 2650509.

The function of the string model calculator 13 shown in FIG. 1 will now be described in detail.

Figure 2:
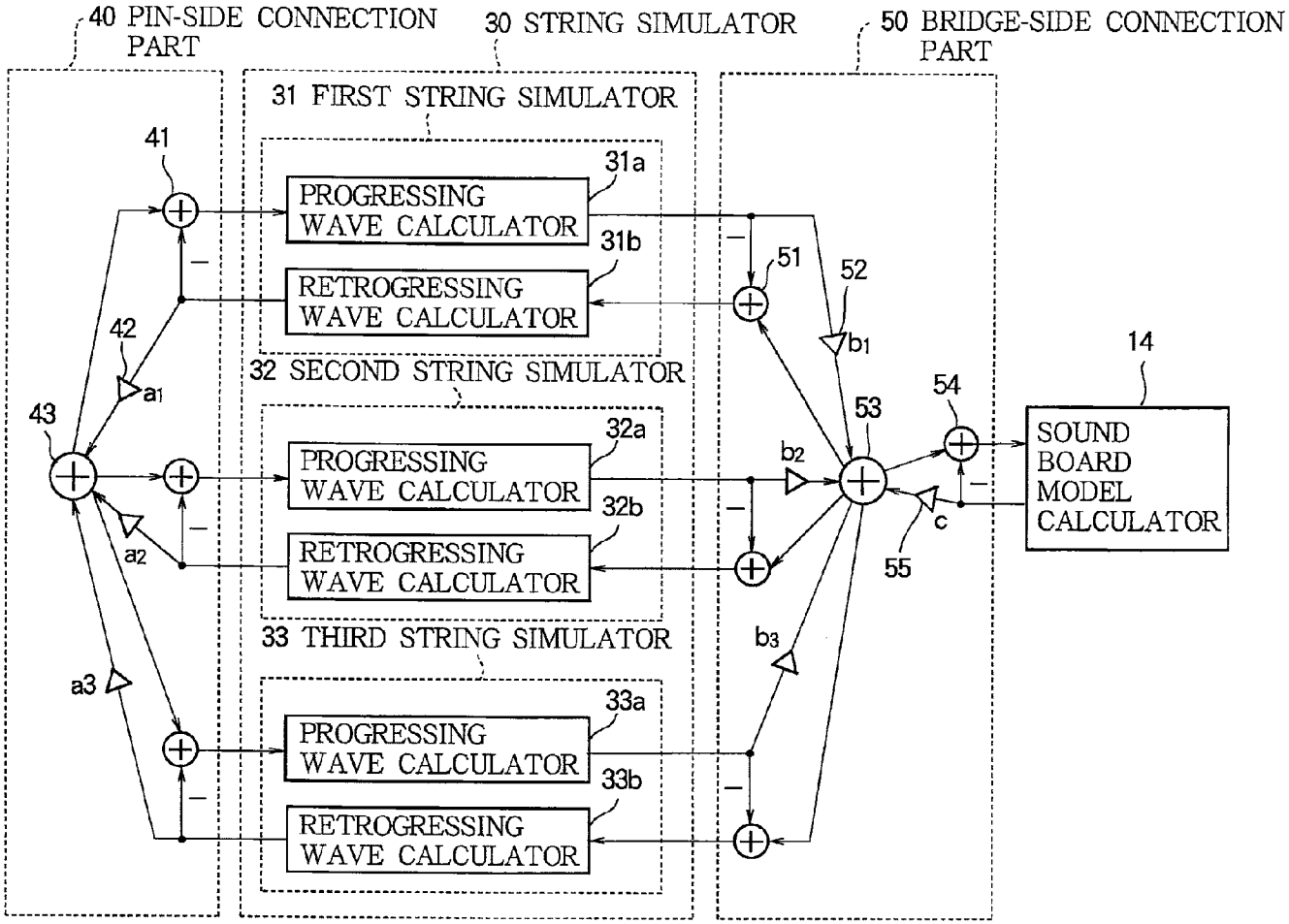
FIG. 2 shows a brief configuration of a string model included in a string model calculator shown in FIG. 1.

FIG. 2 shows an overall configuration of a string model included in the string model calculator 13. A piano has 88 notes each corresponding to one to three strings according to a pitch thereof. FIG. 2 shows a part for reproducing actions of three strings corresponding to one note. In practice, string models corresponding to 3 strings×88 notes are set in case of piano. That is, a string model including as many string simulators as the number of the strings is set.

In the musical sound synthesizing apparatus 10, as shown in FIG. 2, the string model calculator 13 includes a string simulator 30, a pin-side connection part 40, and a bridge-side connection part 50.

In the piano, a portion of a string between a pin (tuning pin) and a bridge mechanically vibrates in general. The string simulator 30 models the action of this portion of the string. The pin-side connection part 40 and the bridge-side connection part 50 respectively model transfer of energy between strings through contact of each string to each pin and each bridge. In addition, energy propagation occurs between the bridge and the sound board, and thus the bridge-side connection part 50 also includes a configuration for modeling the energy transfer therebetween.

The string simulator 30 includes first, second and third string modulators 31, 32 and 33 respectively corresponding to three strings. While a string vibration wave propagated from a pin to the bridge is considered as a progressing wave and a string vibration wave propagated from the bridge to the pin is considered as a retrogressing wave, each string simulator includes a progressing wave calculator which models the behavior of a progressing wave and a retrogressing wave calculator which models the behavior of a retrogressing wave. A description will be given of a configuration relating to the first string simulator 31 as a representative example of the string simulator.

A progressing wave calculator 31*a* and a retrogressing wave calculator 31*b* included in the first string modulator 31 are connected to each other through an adder 41 included in the pin-side connection part 40 and an adder 51 included in the bridge-side connection part 50 to form a loop part. In this loop, a waveform that simulates vibration of a string can be generated in the progressing wave calculator 31*a* and the retrogressing wave calculator 31*b* by delaying vibrations propagating through the progressing wave calculator 31*a* and the retrogressing wave calculator 31*b* according to the length of the string and a vibration propagation velocity of the string.

Here, the output of the progressing wave calculator 31*a* is inverted by the adder 51 and input to the retrogressing wave calculator 31*b* and the output of the retrogressing wave calculator 31*b* is inverted by the adder 41 and input to the progressing wave calculator 31*a* so as to simulate fixed end reflection in the bridge and the pin.

The pin-side connection part 40 and the bridge-side connection part 50 include a waveguide junction which models the above-mentioned energy exchange between strings.

Specifically, in the pin-side connection part 40 to which an adder 43 is provided, outputs of the retrogressing wave calculators of the string simulators are multiplied by coefficients $a_1$, $a_2$ and $a_3$ which indicate contributions of corresponding strings by means of multipliers, respectively, and then input to the adder 43 to be summed. The sum is added to inputs of the progressing wave calculators.

In the case of the first string simulator 31, the output of the retrogressing wave calculator 31*b* is multiplied by coefficient $a_1$ in a multiplier 42 and then applied to the adder 43, and the addition result of the adder 43 is added as a propagation component from another string through the pin to a fixed end reflection component by the adder 41.

The same adders and multipliers (coefficients $b_1$, $b_2$ and $b_3$ which indicate contributions of corresponding strings) as those of the pin-side connection part 40 are provided to the bride-connected part 50. In the case of the first string simulator 31, the output of the progressing wave calculator 31*a* is multiplied by coefficient $b_1$ in a multiplier 52 and applied to an adder 53, and the addition result of the adder 53 is added as a propagation component from another string through the bridge to a fixed end reflection component by the adder 51.

It is noted that the bridge-side connection part 50 is configured such that a signal indicating vibration from the bridge can be input to the sound board model calculator 14 via the adder 54 since the bridge-side connection part 50 models reciprocation of energy with the sound board. The output of the sound board model calculator 14 is multiplied by a coefficient c which indicates contribution of the sound board in a multiplier 55 and applied to the adder 53 and added to inputs from the corresponding strings.

Here, the sound board model calculator 14 performs calculations according to a sound board model corresponding to a filter that simulates characteristics of the piano sound board which receives a vibration waveform from the bridge and outputs a vibration waveform obtained by imparting the effect of resonance according to the sound board to the input vibration waveform.

A route along which the output of the sound board model calculator 14 is inverted and input to the adder 54 functions as part of a loop for generating a signal indicating vibration of the sound board. The sound board model calculator 14 can use an FIR filter shown in FIG. 6 of Japanese Patent publication No. 265050 and the resonant sound generating circuit shown in FIG. 9 of Japanese Patent publication No. 265050, for example.

The sound board model calculator 14 is shared by all string models which constitute the string model calculator 13, receives signals from all the string models, and outputs a signal to all the string models.

The sum of output signals of the progressing wave calculators or retrogressing wave calculators of the respective string simulators is output as waveform data of a musical sound according to a note-on key from the string model calculator 13. The output of the string model calculator 13 corresponds to the sum of output signals of all the string models constituting the string model calculator 13. Since the string model shown in FIG. 2 includes a route from the junction (adder 53) to each string, it is possible to simulate resonance of two strings, that is, propagation of vibration of one string to other string through the junction.

Figure 3:
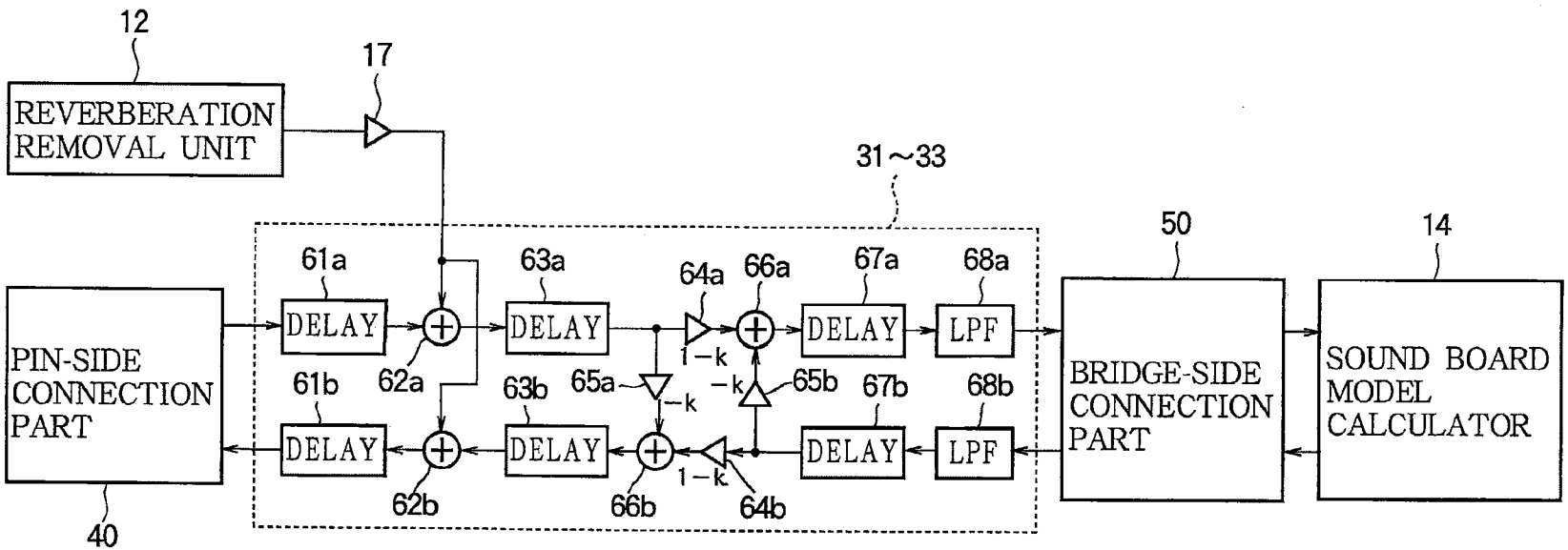
FIG. 3 shows a detailed configuration of each string simulator shown in FIG. 2.

FIG. 3 shows the configuration of each string simulator shown in FIG. 2 in more detail.

In the configuration of FIG. 3, upper components ranging from a delay 61*a* to a low pass filter (LPF) 68*a* correspond to the progressing wave calculator and lower components ranging from an LPF 68*b* to a delay 61*b* correspond to the regressive wave calculator.

Among these components, adders 62*a* and 62*b* add a signal indicative of mechanical vibration of a string struck by a hammer as an excitation signal. The excitation signal that reproduces a waveform when the hammer strikes the string is input to the string simulator corresponding to the string by removing through the reverberation removal unit 12 a resonance component and a reverberation component from waveform data generated by the sound source unit 11 according to a note-on event from the keyboard 21, multiplying the resonance-removed and reverberation-removed waveform data by a predetermined coefficient by means of a multiplier 17 so as to adjust the level of the waveform data, and adding the level-controlled waveform data to the string simulator. In the case where a plurality of strings is arranged for one note, the same waveform data is input to corresponding string simulators.

In addition, a damping coefficient DCc for applying a high gain (low damping factor) to the LPFs 68*a* and 68*b* is set in order to reproduce a state where vibration of a string is not abruptly attenuated due to separation of a damper from the string. Conversely, when the damper comes into contact with the string due to key release, a damping coefficient DCc for applying a low gain (high damping rate) to the LPFs 68*a* and 68*b* is set in order to reproduce abrupt attenuation of vibration of the string due to the damper. Of course, it is possible to reproduce a state where the damper slightly touches the string by setting a damping coefficient DCx between the damping coefficients DCc and DCo. Damping factors according to the damping coefficients have a relationship of 1>DCo>DCx>DCc>0.

Multipliers 64*a*, 64*b*, 65*a* and 65*b* and adders 66*a* and 66*b* model the function of the damper. When the damper is in contact with a string, the location of the damper is regarded as a fixed end, which is simulated by setting a coefficient k multiplied by each multiplier to 1. When k is set to 0, the multipliers and adders do not affect vibration of the string, and a state in which the damper is separated from the string can be simulated.

Further, it is possible to simulate a state in which the damper moderately touches the string by setting k to a value between 0 and 1. In addition, it is possible to simulate a state in which the damper gradually comes into contact with the string or state in which the damper is gradually separated from the string by gradually changing k from 0 to 1 or from 1 to 0. The aforementioned damping coefficients can also be gradually changed.

The damping coefficients and the coefficient k are set by the string model controller 15 according to a note-on event and note-off event from the keyboard 21 and a pedal ON/OFF event from the sustain pedal 22. When a key is depressed, a damper of a string corresponding to the key is released before a hammer strikes the string. When the key is released, the damper is brought into contact with the string. Dampers of all strings are released when the sustain pedal is on whereas the dampers are returned when the sustain pedal is released.

Delays 61*a*, 61*b*, 63*a*, 63*b*, 67*a* and 67*b* for delaying a time required for vibration to propagate through the string are provided to three points for each of a progressing wave and a retrogressing wave and divide a delay time corresponding to one string into three depending on the relationship among the locations of the pin, hammer, damper and bridge which need to be simulated.

The LPFs 68*a* and 68*b* simulate damping of a high-order vibration wave faster than that of a low-order vibration wave according to propagation of vibration. The LPFs 68*a* and 68*b* gradually attenuate the low-order vibration wave to simulate natural damping.

Each string simulator shown in FIG. 2 can reproduce vibration of a string considering a strike by a hammer and suppression by a damper. The first, second and third string simulators 31, 32 and 33 perform the same calculation process with different delays depending on oscillation periods of strings corresponding thereto.

The configuration of the reverberation removal unit 12 shown in FIG. 1 will now be described in detail.

Figure 4:
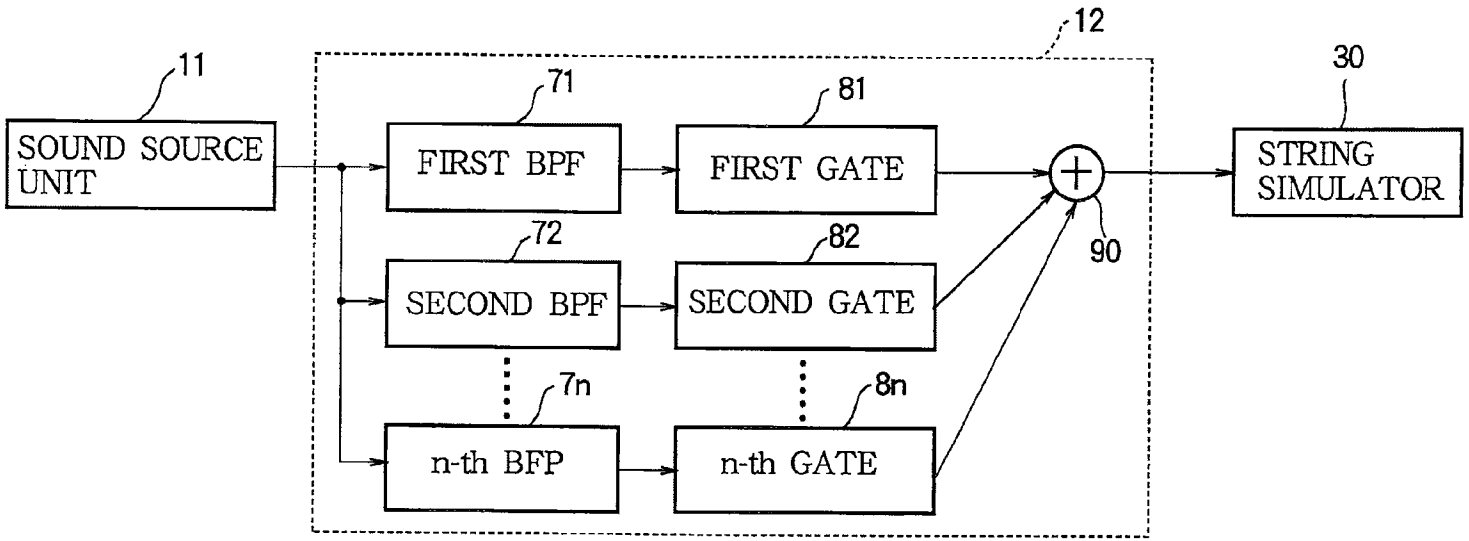
FIG. 4 shows a configuration of a reverberation removal unit shown in FIG. 1.

FIG. 4 shows the configuration of the reverberation removal unit 12.

As shown in FIG. 4, the reverberation removal unit 12 includes n band pass filters (BPFs) 71 to 7n, n gates 81 to 8n respectively corresponding to the BPFs 71 to 7n, and an adder 90.

Figure 5:
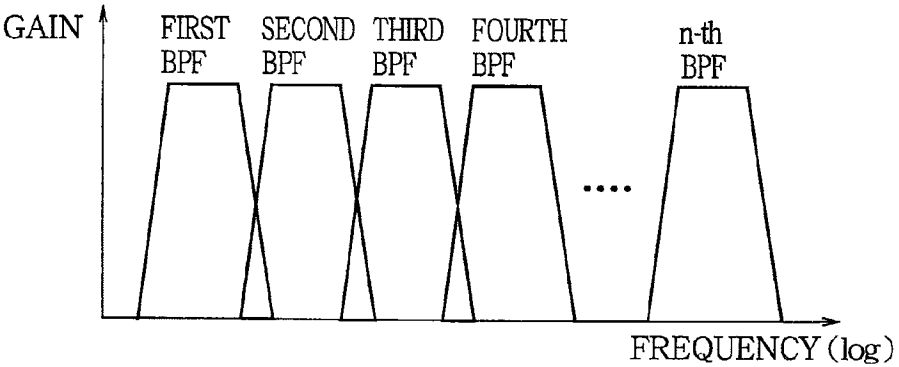
FIG. 5 illustrates filter characteristics of a filter provided to the reverberation removal unit.

The BPFs 71 to 7n are preferably configured such that pass bands of neighboring filters do not overlap while covering frequencies in the range of the lowest note to the highest note of the keyboard 21 as passbands. It is desirable that the width of the pass band of each BPF should be a mean width in a log scale frequency. FIG. 5 shows examples of characteristics of the BPFs which satisfy the above-mentioned condition.

To obtain desirable filter characteristics, the center frequency of the pass band of each BPF can be adjusted to the frequencies of pitches of 88 keys of the keyboard 21 such that the filter can pass signals of frequencies belonging to corresponding 1/12 octave.

Alternatively, one band pass filter may be provided for every four keys such that 22 band pass filters pass signals of frequencies belonging to 1/3 octave corresponding thereto. Otherwise in more precise form, two band pass filters per key may be provided such that 176 band pass filters pass signals of frequencies belonging to 1/24 octave corresponding thereto.

While a signal having a desirable property is obtained after resonance and reverberation removal when a precise filter is used, a large quantity of calculation resources is required for signal processing. Accordingly, an appropriate number of bands is determined in consideration of used resources.

The waveform data input from the sound source unit 11 can be divided into waveform data of frequency bands respectively corresponding to the BPFs through the BPFs 71 to 7n.

It is possible to replace a band pass filter corresponding to the lowest note by a low pass filter and replace a band pass filter corresponding to the highest note by a high pass filter.

Figure 6:
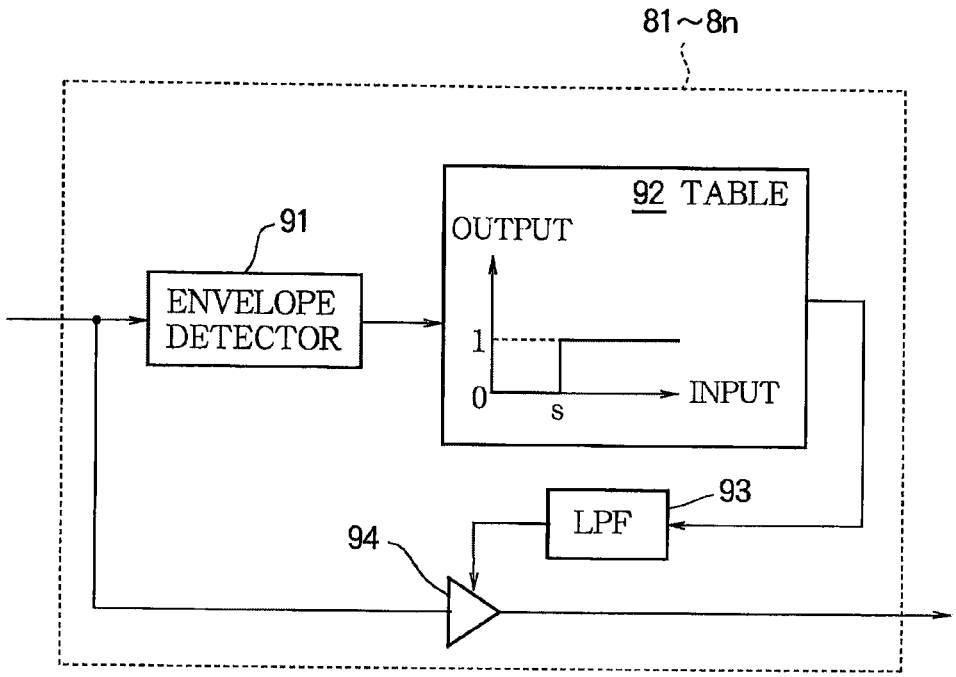
FIG. 6 shows a configuration of a gate shown in FIG. 4.

FIG. 6 shows the configuration of the gates 81 to 8n shown in FIG. 4 in more detail.

As shown in FIG. 6, each of the gates 81 to 8n includes an envelop detector 91, a table 92, an LPF 93, and a multiplier 94.

The envelop detector 91 detects the level (envelope value) of the output waveform of the BPF corresponding to the gate and applies the detected level to the table 92. The table 92 outputs 0 when the level input thereto is below a predetermined threshold value s and outputs 1 when the input level exceeds the threshold value s. The LPF 93 smoothes a coefficient applied to the multiplier 94 such that the coefficient is not abruptly changed. The LPF 93 may be replaced by a coefficient interpolator. The output of the table 92 is set as a multiplication coefficient to the multiplier 94 through the LPF 93. The output waveform of the corresponding BPF is multiplied by the multiplication coefficient and input to the adder 90 shown in FIG. 4.

According to the above-described components, each of the gates 81 to 8n can pass a component of a frequency band which has passed through the corresponding BPF from among the waveform data input from the sound source unit 11 when the level of the frequency band exceeds a predetermined value, and can attenuate the component when the level does not reach the predetermined value.

Therefore, it is possible to generate waveform data, obtained by removing a component of a frequency band corresponding to a level that does not reach a predetermined level from the waveform data input from the sound source unit 11 by summing outputs of the gates 81 to 82 through the adder 90.

The volume level of a frequency component initially generated when a string is struck by a hammer in response to depression of a key corresponding to the string among various frequency components of the waveform data input from the sound source unit 11 is considered to be higher than the volume level of resonance and reverberation components caused by vibration propagation in the string after the string is struck, vibration of the sound board, resonance between strings, etc. Therefore, by removing a low-level frequency band component using the reverberation removal unit 12, it is possible to effectively eliminate components other than an initial component generated from a string struck by a hammer from waveform data obtained by sampling a sound generated from a piano particularly in a state where vibration is not restricted and input the waveform data to the string simulator 30 even when the waveform data is used for generation of sound in the sound source unit 11, and easily obtain waveform data of the sound generated from the string struck by the hammer.

Namely, according to the invention, a waveform memory stores first waveform data representing sound which is sampled from a natural musical instrument having a string, such that the sampled first waveform data contains a strong frequency component being directly associated to mechanical vibration of the string and therefore having a level greater than the predetermined level, and contains a weak frequency component being associated to the resonance and reverberation caused by the mechanical vibration and therefore having a level lower than the predetermined level. The reverberation removal unit 12 is a waveform processing unit that selectively removes the weak frequency component and outputs second waveform data that contains the strong frequency component and does not contain the weak frequency component.

Accordingly, even when interaction between a hammer and a string is not physically modeled, it is possible to apply natural input data that simulates energy of a struck string in a real piano to the string simulator 30. In other words, since an excitation signal supplied to a string model of a stringed instrument can be generated from a waveform obtained by sampling a sound of the stringed instrument, a simulation model for a struck string is not needed and sound quality deterioration caused by insufficient reproduction by a model does not occur.

Moreover, little effort is needed to sample waveform data used by the sound source unit 11, and thus it is possible to sample the waveform data of musical instruments of various models or various playing styles at a low cost and reproduce sounds according to musical instruments of various models and various playing styles at a low cost.

It can be considered that waveform data of a sound generated from a string struck by a hammer correctly reflects the energy applied to the string according to the hammer's strike on the string and physical vibration generated in the string after the strike can be appropriately reproduced by inputting the waveform data as an excitation signal to the string model.

Specifically, when a certain key is note-on, an excitation signal caused by a string struck by a hammer is supplied to a string model corresponding to the pitch of the note-on key from among the plurality of string models, generating vibration in the string model. The vibration propagates to the sound board model and another string model via the junction, and thus the sound board model is provided with reverberation caused by vibration of the sound board and the other string model is provided with reverberation caused by resonance of the string. As to resonance of the other string model, when the damper pedal is off, models of strings in a harmonic relationship from among strings corresponding to keys (note-on keys) depressed at that time resonate in most cases. When the damper pedal is on, all strings in a harmonic relationship resonate. When a plurality of keys is simultaneously depressed, an excitation signal is supplied to a string model corresponding to each of the keys, and vibration is generated in the string model and propagated to the sound board model and other string models. Vibrations and resonances generated in the string models and reverberation generated in the sound board model are mixed in the output waveform generator 16 to generate an output waveform.

It is considered that a sound generated when a string is struck by a hammer is output for a very short time after the strike. Accordingly, output of waveform data from the sound source unit 11 may be stopped or the overall frequency component of the reverberation removal unit 12 may be cut after lapse of a predetermined time from a note-on event.

Namely, the musical sound synthesizing apparatus includes an input unit such as keyboard 21 that starts inputting of the excitation signal to the loop part of the string model calculator 13 in response to the sound generation instruction of the note-on event, and that stops the inputting of the excitation signal to the loop part upon lapse of a predetermined time while the loop part continues to synthesize the musical sound signal.

Hardware for implementing the above-described musical sound synthesizing apparatus 10 will now be described.

Figure 7:
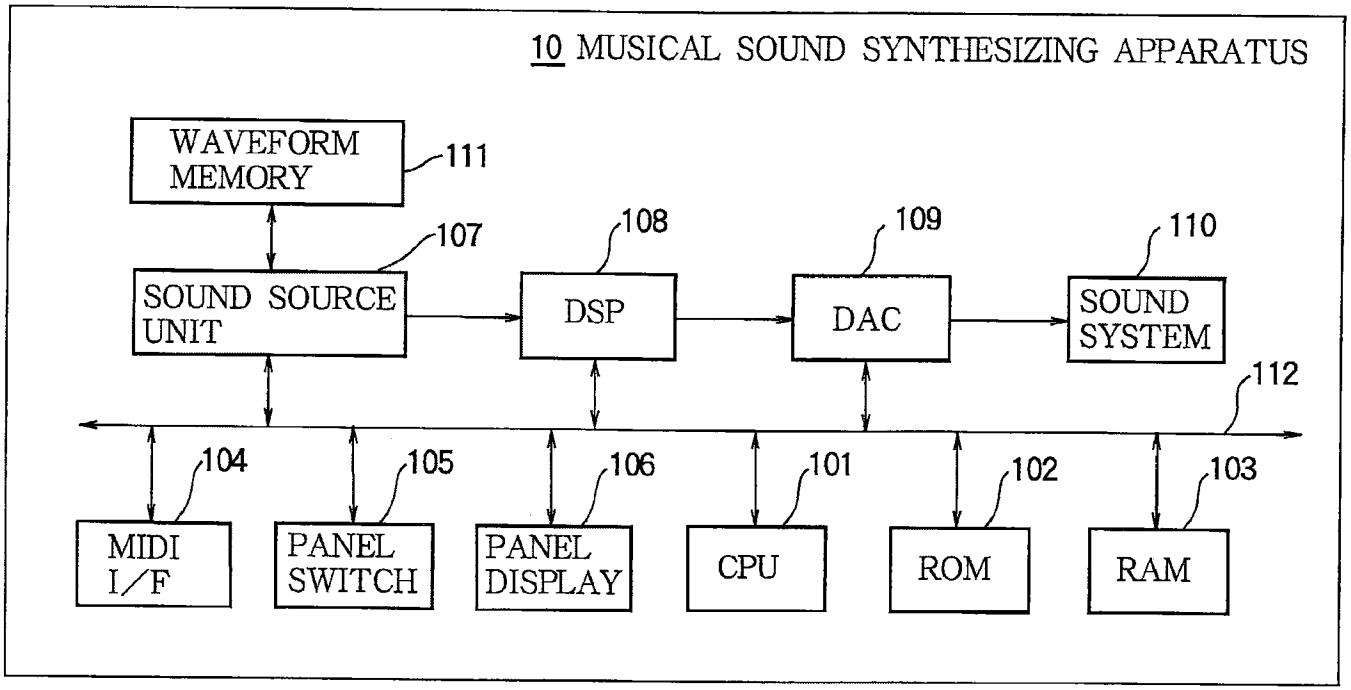
FIG. 7 is a block diagram of hardware implementing the musical sound synthesizing apparatus.

FIG. 7 shows exemplary hardware implementing the musical sound synthesizing apparatus 10.

As shown in FIG. 7, the musical sound synthesizing apparatus 10 may include a CPU 101, a ROM 102, a RAM 103, a MIDI I/F (interface) 104, a panel switch 105, a panel display 106, a sound source unit 107, a digital signal processor (DSP) 108, and a digital-to-analog converter (DAC) 109, which are connected through a system bus 112, a sound system 110, and a waveform memory 111.

The CPU 101 for controlling the overall musical sound synthesizing apparatus 10 detects manipulation of the panel switch 105, controls display of the panel display 106, controls communication via the MIDI I/F 104, generates waveform data from the sound source unit 107, calculates waveform data by means of the DSP 108, and controls digital-to-analog conversion in the DAC 109 by executing required control programs stored in the ROM 102. In addition, the CPU 101 executes the function of the string model controller 15 and functions related to supply of an event to the sound source unit 11 and the string model controller 15 shown in FIG. 1.

The ROM 102 is a nonvolatile memory, which is rewritable and which is composed of a flash memory or the like, to store data which need not be frequently changed, such as control programs executed by the CPU 101, image data corresponding to images displayed on the panel display 106, data of parameters used for processing of the reverberation removal unit 12 and the string model calculator 13, etc.

The RAM 103 is a memory used as a working memory of the CPU 101.

The MIDI I/F 104 is an interface for input/output of MIDI data between manipulators including the keyboard 21 and the sustain pedal 22 and an external device such as a MIDI sequencer that provides performance data indicating details of a performance.

The panel switch 105 is a manipulator such as a button, a knob, a slider, a touch panel, or the like provided on a manipulation panel and receives various instructions from a user, such as setting parameters, switching images and operation modes, etc.

The panel display 106 is implemented as a liquid crystal display (LCD), a light emitting diode (LED) display or the like and displays an operating state and set conditions of the musical sound synthesizing apparatus 10, a message to the user, a graphical user interface (GUI) for receiving an instruction from the user, etc.

The sound source unit 107 has the same function as that of the sound source unit 11 described with reference to FIG. 1. Waveform data read by the sound source unit 107 is stored in the waveform memory 111.

The DSP 108 executes signal processing according to the functions of reverberation removal unit 12, the string model calculator 13, the sound board model calculator 14 and the output waveform generator 16, which have been described with reference to FIGS. 1 to 6. The DSP 108 may be implemented as a programmable processor.

The DAC 109 converts digital waveform data output from the DSP 108 into an analog sound signal and drives a speaker of the sound system 110. The sound system 110 is not necessary when the musical sound synthesizing apparatus 10 is configured to output musical sound signals instead of voices.

The DAC 109 is also unnecessary when the musical sound synthesizing apparatus 10 is configured to output digital waveform data rather than analog signals.

While the embodiments of the present invention have been explained above, the configuration of the apparatus, model structure, detailed sequences and contents of calculations are not limited thereto.

Figure 8:
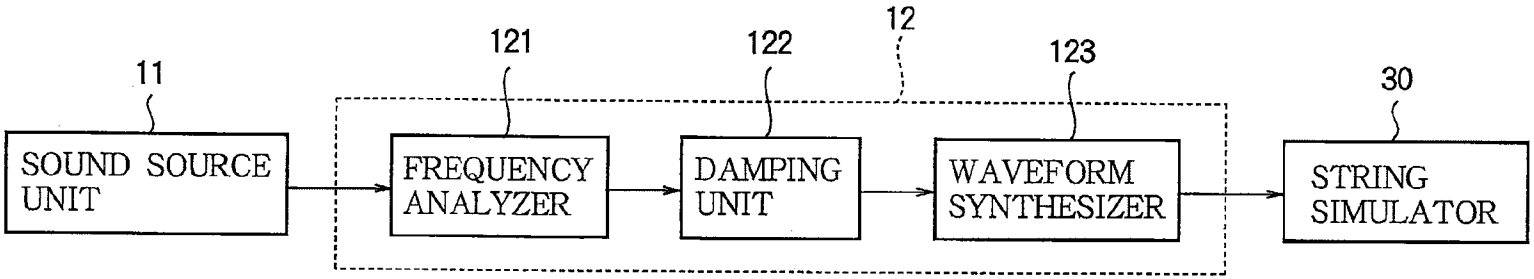
FIG. 8 is a block diagram showing a modification of the reverberation removal unit.

For example, the reverberation removal unit 12 can employ the configuration shown in FIG. 8.

That is, the reverberation removal unit 12 can include a frequency analyzer 121, a damping unit 122 and a waveform synthesizer 123.

Figure 9:
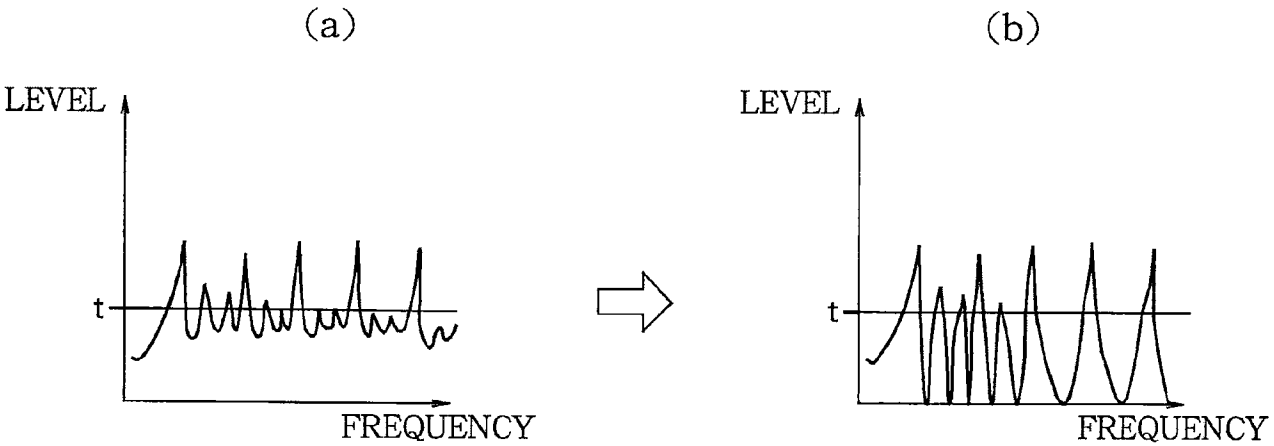
FIG. 9 is graphs illustrating operation of the reverberation removal unit shown in FIG. 8.

Specifically, the frequency analyzer 121 analyzes the frequency of waveform data generated by the sound source unit 11 to obtain first frequency characteristic data indicative of the frequency characteristics or frequency spectrum of the waveform data, as shown in FIG. 9(*a*). Then, the damping unit 122 attenuates the level of frequency components having a level that does not reach a predetermined threshold value t from among the obtained frequency characteristic data so as to generate second frequency characteristic data as shown in FIG. 9(*b*). Subsequently, the waveform synthesizer 123 generates waveform data having the frequency characteristic or frequency spectrum indicated by the second frequency characteristic data on the basis of the second frequency characteristic data.

Similarly to the reverberation removal unit 12 according to the above-mentioned embodiments, it is possible to generate waveform data containing solely a sound component generated from a string struck by a hammer in response to a depressed key by removing a frequency band component having a volume level that does not reach a predetermined level from among the waveform data input from the sound source unit 11 through the aforementioned components.

The frequency analyzer 121 can perform frequency analysis through fast Fourier transform (FFT) and the waveform synthesizer 123 can generate waveform data through inverse fast Fourier transform (IFFT). Here, a window length is set to approximately 128 to 2048 samples considering real-time processing. In the case of 1048 samples, a sampling frequency of 50 KHz corresponds to about 4 msec. If the window is narrowed, frequency resolution decreases while delay is reduced, and thus it is not desirable to excessively reduce the number of samples.

It can be considered that processing of the reverberation removal unit 12 is performed and waveform data obtained by such processing, that is, waveform data of an excitation signal, is stored in the waveform memory of the sound source unit 11 before playing. In this case, the processing by the reverberation removal unit 12 is unnecessary and waveform data read by the sound source unit 11 from the waveform memory bypasses the reverberation removal unit 12 to be directly supplied to the string model calculator 13 (multiplier 17). In this case, there is no need to perform the processing of the reverberation removal unit 12 in real time since the processing is carried out in advance, and thus calculations of FFT and IFFT can be performed with high precision using a longer window.

Namely, the musical sound synthesizing apparatus may be equipped with a storage that stores waveform data which has been previously generated by the reverberation removal unit 12, and an input unit that reads out the waveform data from the storage and inputs the excitation signal formed of the read waveform data to the loop part in response to the sound generation instruction, so that the loop part starts synthesizing the musical sound in response to the sound generation instruction.

Alternatively, calculation algorithms of the string model calculator 13 and the sound board model calculator 14 shown in FIG. 1 may differ from those in the above-described embodiment. The present invention can be applied to any model that generates a musical sound signal if the model includes a loop part composed of a loop including at least a delay and inputs an excitation signal to the loop part in response to a sound generation instruction so as to synthesize a musical sound signal.

While the aforementioned embodiments have described examples of reproducing musical tones of a piano, the present invention can be applied to any musical instrument so long as the musical instrument applies vibration to fixed strings to generate sounds.

Furthermore, the above-mentioned modifications including the descriptions of the embodiments can be arbitrarily combined and applied without departing from the spirit and scope of the present invention.

As can be understood from the above description, the musical tone generating apparatus of the present invention can generate an excitation signal supplied to a string model of a stringed instrument from waveform data obtained by sampling a sound of the stringed instrument.

Therefore, a musical sound synthesizing apparatus capable of outputting a variety of musical tones can be easily implemented according to the present invention.

What is claimed is:

1. A musical sound synthesizing apparatus comprising:

a loop part including at least a delay element, the loop part being configured to receive an excitation signal in response to a sound generation instruction so as to synthesize a musical sound signal by looping the excitation signal therein;

a waveform memory that stores first waveform data representing sound which is generated by a natural musical instrument and which contains resonance, the first waveform data containing a plurality of frequency components having various levels; and a waveform processing unit that removes, from the first waveform data, one or more frequency component having a level that does not reach a predetermined level, to generate second waveform data, wherein the waveform processing unit comprises:

a separator that separates the first waveform data into waveform data of a plurality of frequency bands;

a plurality of level controllers that respectively correspond to the plurality of the frequency bands, each level controller detecting a level of the waveform data of the corresponding frequency band and damping the waveform data when the detected level does not reach the predetermined level, thereby removing a frequency component contained in the first waveform data; and a waveform synthesizer that mixes the waveform data output from the plurality of the level controllers to generate the second waveform data, wherein the second waveform data generated by the waveform processing unit is input as the excitation signal to the loop part.

2. A musical sound synthesizing apparatus comprising:

a loop part including at least a delay element, the loop part being configured to receive an excitation signal in response to a sound generation instruction so as to synthesize a musical sound signal by looping the excitation signal therein;

a waveform memory that stores first waveform data representing sound which is generated by a natural musical instrument and which contains resonance, the first waveform data containing a plurality of frequency components having various levels; and a waveform processing unit that removes, from the first waveform data, one or more frequency component having a level that does not reach a predetermined level, to generate second waveform data, wherein the waveform processing unit comprises:

a frequency analyzer that analyzes the first waveform data so as to obtain a first frequency characteristic indicating frequency components contained in the first waveform data;

a damping unit that decreases a level of one or more frequency component which does not reach a predetermined level in the first frequency characteristic so as to obtain a second frequency characteristic; and a waveform synthesizer that generates the second waveform data having the second frequency characteristic, wherein the second waveform data generated by the waveform processing unit is input as the excitation signal to the loop part.

3. A musical sound synthesizing apparatus comprising:

a loop part including at least a delay element, the loop part being configured to receive an excitation signal in response to a sound generation instruction so as to synthesize a musical sound signal by looping the excitation signal therein;

a waveform memory that stores first waveform data representing sound which is generated by a natural musical instrument and which contains resonance, the first waveform data containing a plurality of frequency components having various levels; and a waveform processing unit that removes, from the first waveform data, one or more frequency component having a level that does not reach a predetermined level, to generate second waveform data, wherein the waveform memory stores the first waveform data representing sound which is sampled from a natural musical instrument having a string, such that the sampled first waveform data contains a strong frequency component being directly associated to mechanical vibration of the string and therefore having a level greater than the predetermined level, and contains a weak frequency component being associated to the resonance caused by the mechanical vibration and therefore having a level lower than the predetermined level, wherein the waveform processing unit selectively removes the weak frequency component so that the second waveform data contains the strong frequency component and does not contain the weak frequency component, and wherein the second waveform data generated by the waveform processing unit is input as the excitation signal to the loop part.

4. A musical sound synthesizing apparatus comprising:

a loop part including at least a delay element, the loop part being configured to receive an excitation signal in response to a sound generation instruction so as to synthesize a musical sound signal by looping the excitation signal therein;

a waveform memory that stores first waveform data representing sound which is generated by a natural musical instrument and which contains resonance, the first waveform data containing a plurality of frequency components having various levels;

a waveform processing unit that removes, from the first waveform data, one or more frequency component having a level that does not reach a predetermined level, to generate second waveform data, wherein the second waveform data generated by the waveform processing unit is input as the excitation signal to the loop part;

a storage that stores the second waveform data which has been generated by the waveform processing unit; and an input unit that reads out the second waveform data from the storage and inputs the excitation signal formed of the read second waveform data to the loop part in response to the sound generation instruction, so that the loop part starts synthesizing the musical sound signal in response to the sound generation instruction.

5. A musical sound synthesizing apparatus comprising:

a loop part including at least a delay element, the loop part being configured to receive an excitation signal in response to a sound generation instruction so as to synthesize a musical sound signal by looping the excitation signal therein;

a waveform memory that stores first waveform data representing sound which is generated by a natural musical instrument and which contains resonance, the first waveform data containing a plurality of frequency components having various levels;

a waveform processing unit that removes, from the first waveform data, one or more frequency component having a level that does not reach a predetermined level, to generate second waveform data, wherein the second waveform data generated by the waveform processing unit is input as the excitation signal to the loop part; and an input unit that starts inputting of the excitation signal to the loop part in response to the sound generation instruction, and that stops the inputting of the excitation signal to the loop part upon lapse of a predetermined time while the loop part continues to synthesize the musical sound signal.

* * * * *